US005643647A

United States Patent [19]

Wischusen, III

[11] Patent Number: 5,643,647

[45] Date of Patent: Jul. 1, 1997

[54] LOOSE FILL DUNNAGE ELEMENTS OF PAPERBOARD OR THE LIKE

[75] Inventor: Henry Wischusen, III, Lilburn, Ga.

[73] Assignee: Rock-Tenn Company, Norcross, Ga.

[21] Appl. No.: 662,066

[22] Filed: Jun. 12, 1996

[51] Int. Cl.[6] ..... B32B 1/00; B32B 1/08

[52] U.S. Cl. ..... 428/36.9; 206/584; 206/814; 493/967; 428/98

[58] Field of Search ..... 428/36.9, 57, 98; 206/584, 814; 493/967

[56] References Cited

U.S. PATENT DOCUMENTS

| | | | |
|---|---|---|---|
| 1,901,898 | 3/1933 | Clarke | 93/1 |
| 2,012,427 | 8/1935 | Haun | 251/93 |
| 2,292,582 | 8/1942 | Tate | 93/1 |
| 2,791,948 | 5/1957 | Flood | 93/1 |
| 3,051,345 | 8/1962 | Flynn | 217/34 |
| 3,578,305 | 5/1971 | Muelhauser | 267/165 |
| 3,792,672 | 2/1974 | Friedman et al. | 112/104 |
| 5,134,013 | 7/1992 | Parker | 428/182 |
| 5,213,867 | 5/1993 | Huston, Sr. et al. | 428/126 |
| 5,308,677 | 5/1994 | Renna | 428/174 |
| 5,312,665 | 5/1994 | Platt et al. | 428/402 |
| 5,468,556 | 11/1995 | Fuss et al. | 428/154 |

OTHER PUBLICATIONS

PIP Testing Results, Rock–Tenn Company internal document (undated, refers to item AS below).

Federal Specification Cushioning Material, Expanded Polystyrene Loose–Fill Bulk (For Packaging Application) PPP–C–1683 Feb. 5, 1973.

Dynamic Test Report on PIPS Loose Fill Material, gh Package & Product Testing and Consulting, Inc., May 24, 1995.

Declaration of Henry Wischusen, III, dated Sep. 26, 1996.

*Primary Examiner*—Alexander Thomas

*Attorney, Agent, or Firm*—Jones & Askew, LLP

[57] ABSTRACT

A tubular dunnage element or paperboard or the like has a tucked or heart-shaped radial cross section, and a slanted axial cross section. The element may be compressed by opposed inward forces along any line through the center of the element. The element is suited for use as a loose fill packing material. Serrated edges cause the elements in a bed to catch on one another, resisting the tendency of a packed article to migrate through the bed to a wall of a container under the influence of vibration occurring during shipment.

18 Claims, 2 Drawing Sheets

LOOSE FILL DUNNAGE ELEMENTS OF PAPERBOARD OR THE LIKE

TECHNICAL FIELD

The present invention relates to loose fill packing of articles for shipment, and more particularly relates to a loose fill dunnage or packing element formed of paperboard or the like.

BACKGROUND ART

Safe shipment of a wide variety of articles, many of them fragile, is critical to modem commerce. Many articles of manufacture must be packaged for shipment by common carrier, and therefore may be subject to rough handling. When such articles are fragile, they must be protected against the possibility that their container may be dropped, battered, or pierced. A common approach to protecting fragile articles is to place the article in a corrugated container surrounded by packing material. Many different types of packing have been used to protect items being shipped in cartons.

One method has been to use a bed of loose fill such as foam "peanuts" or crumpled paper. When using this method it is important that a fragile article not be able to migrate through the fill as it vibrates during transport, and eventually find its way to an outer wall of the container where the article is less protected. Another method has been to provide a structural insert such as a molded foam jacket which fits the article and occupies all the remaining space in the carton. Although this method is effective in protecting the article, it is very expensive. A fill material such as crumpled paper requires considerable labor to arrange the article in the packing material. Furthermore, the use of synthetic foams has become less desirable because of environmental concerns when the material is not easily recyclable.

Attempts have been made to construct loose fill dunnage elements from paperboard. One such element consists of strips wound into cylinders, which are not compressible along the axis of the cylinder. Another such element consists of a spiral wound strip, which is difficult to make with enough structural strength to adequately protect fragile articles. Examples of U.S. Patents showing packing elements include: U.S. Pat. Nos. 3,051,345; 5,213,867; 5,3;08, 677; and 5,312,665.

SUMMARY OF THE INVENTION

The invention seeks to provide a dunnage material that can cushion an article against force from any direction, does not allow the article to migrate through the fill material, and may be dispensed readily around the article during loading. The present invention also seeks to provide a loose fill dunnage material that is made from recyclable material and can be recycled.

In accordance with the invention, these objects are accomplished by providing a dunnage element made of a flexible sheet material, for example, paperboard, formed into elements that are compressible to cushion a packed article. In a preferred form the elements catch on one another to prevent migration of the article through a bed of the dunnage elements. Generally described, a dunnage element according to the present invention comprises an elongate strip of flexible material defining an outer planar surface, an inner planar surface, an upper elongate edge of the surfaces, a lower elongate edge of said surfaces, a first end, a second end, and a central portion where each of the edges extends to a position spaced below a line connecting points at which the edge meets the ends, the ends being brought together and tucked, the outer surface adjacent to the first end being joined to the outer surface adjacent to the second end to form a closed figure having a tucked portion spaced axially from the central portion of the strip, the figure being resiliently compressible axially as well as radially.

Thus, a dunnage element according to the invention comprises a tube formed of flexible material, the tube having a generally heart-shaped cross section, a generally heart-shaped upper edge, and a generally heart-shaped lower edge; the upper edge being oriented such that a plane roughly aligned with the upper edge is inclined with respect to a central axis of the tube; and the lower edge being oriented such that a plane roughly aligned with the lower edge is inclined with respect to the central axis of the tube with a lowest point on the upper edge being on the same side of the axis as a lowest point on the lower edge.

The preferred material for making the strip is recycled paperboard, although other flexible sheet materials, such as plastic, could be used. The shape of the strip in a preferred embodiment is a sinusoidal curve, and the elongate edges preferably are serrated with V-shaped cuts into the strip.

The present invention also provides, using such dunnage elements, a dunnage system for packing articles, and a method of packing articles. Among the advantages of the preferred dunnage element of the invention are its ability to cushion articles by resiliently compressing under force applied from essentially any direction, and its ability to catch or lock on other elements to prevent the article from migrating through the dunnage elements of the bed.

Other objects, features and advantages of the invention will become apparent upon review of the following detailed description of preferred embodiments of the invention, when taken in conjunction with the drawings and the appended claims.

DETAILED DESCRIPTION

Figure 1:
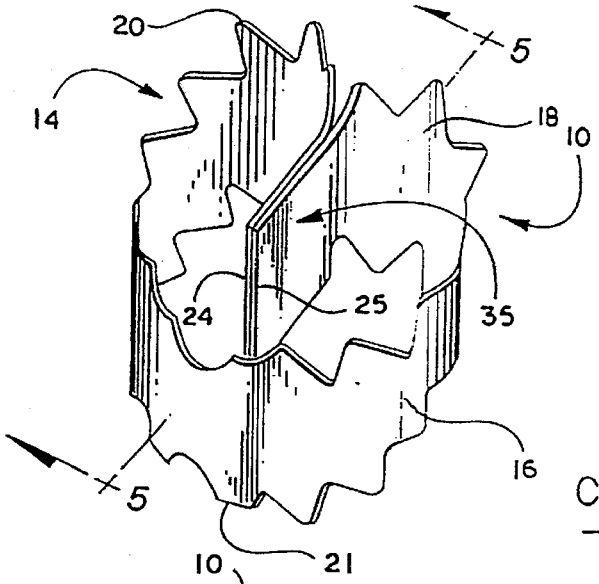
FIG. 1 is a pictorial view of a dunnage element embodying a preferred embodiment of the present invention.
Figure 5:
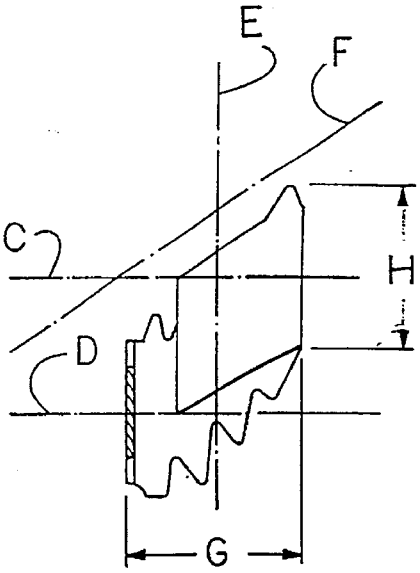
FIG. 5 is a vertical cross sectional view taken along line 5—5 of FIG. 1.
Figure 4:
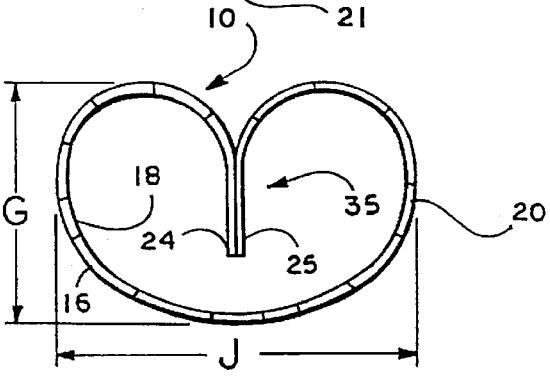
FIG. 4 is a top plan view of the dunnage element of FIG. 1.

Referring now in more detail to the drawings, in which like numerals refer to like parts throughout the several views, FIGS. 1, 4 and 5 show a dunnage element 10 according to a preferred embodiment of the present invention. The dunnage element 10 is formed from a flat blank 10' of flexible sheet material, shown in FIGS. 2 and 3. As will be explained in detail below, the dunnage element 10 has a heart-shaped tubular configuration with serrated edges. These features allow the dunnage element to function advantageously as loose fill packing material.

Each blank 10' is formed by a strip 14 of flexible sheet material having an outer surface 16 and an inner surface 18. An elongate, preferably serrated upper edge 20 and an elongate, serrated lower edge 21 extend between a first end 24 and a second end 25. The upper edge meets the first end at point 20*a*, and meets the second end at point 20*b*. The lower edge meets the first end at point 21*a*, and meets the second end at point 21*b*.

The optional serrations in the elongate edges 20 and 21 preferably are formed by V-shaped cuts 22 into the strip 14. The V-shaped cuts 22 are deep enough so that the dunnage elements 10, when forming a bed, catch on one another to resist migration of a packed article through the bed. Preferably the cuts 22 are at least about ⅛ to about ⅜ deep (3–10 mm), and have a maximum width of about ⅛ to about ⅜ inch (3–10 mm). The V-shaped cuts may meet each other to form tips 26 along the serrated edges 20 and 21. Preferably, the tips 26 are rounded so that when a person reaches into a bed of the dunnage elements to retrieve an article, the tips 26 are not so sharp as to cause discomfort. At the center of the strip 14, a pair of rounded cut-outs 23 may be formed for assistance in handling and separating the blanks 10' from the sheet 10".

The strip 14 preferably is shaped as a sine curve, with a sinusoidal minimum at a center portion 30 of the strip, a sinusoidal maximum 32 spaced inwardly from the first end 24, and a sinusoidal maximum spaced inwardly from the second end 25. Preferably, the general shape of the upper and lower edges, represented, for example, by curves through the tips 26, are about the same distance from one another along the length of the edges, and are generally parallel in this sense. The upper edge 20 in the preferred embodiment extends, at the central portion 30 of the strip, below a line A connecting points 20*a* and 20*b*, and extends, at the maxima 32 and 33, above the line A. Similarly, the lower edge 21 in the preferred embodiment extends, at the central portion 30 of the strip, below a line B connecting points 21*a* and 21*b*, and extends above the line B at the maxima 32 and 33.

The height H of the strip (measured arbitrarily as the maximum vertical distance between points on the upper and lower edges) can vary depending on the nature of the articles to be packed. For a wide range of applications, strip heights from about one inch to about 3 inches (2.5–7.5 cm) will suffice. The thickness of the strip also can vary depending on the nature of the articles to be packed, larger loads requiring a heavier gauge. Preferably, the gauge of the paperboard is from about 12 pt. to about 40 pt. (0.3–1.0 mm).

Figure 2:
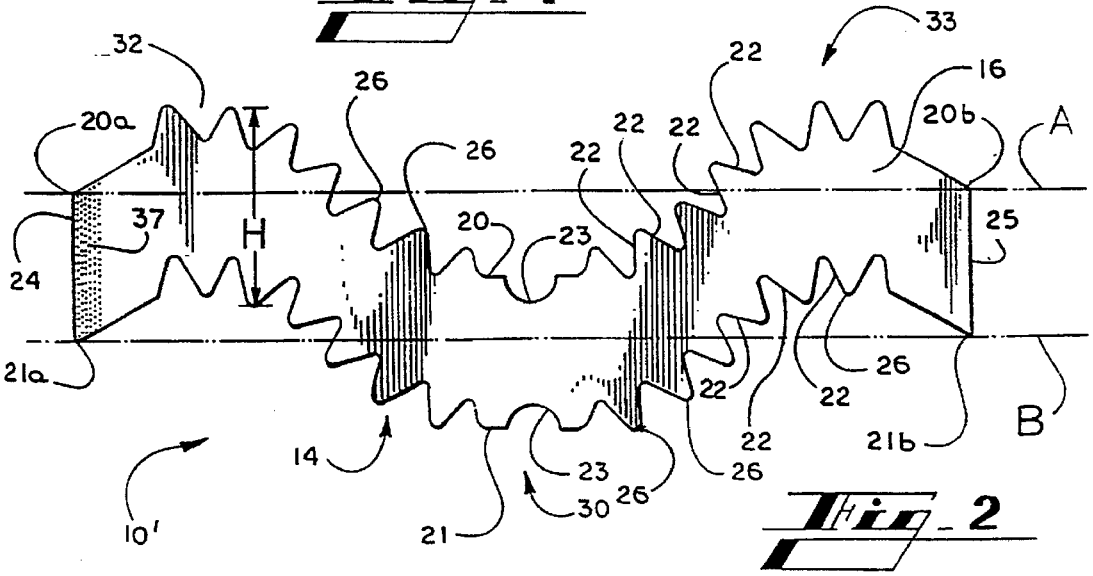
FIG. 2 is a plan view of the outer surface of a paperboard blank from which the dunnage element of FIG. 1 may be assembled.
Figure 3:
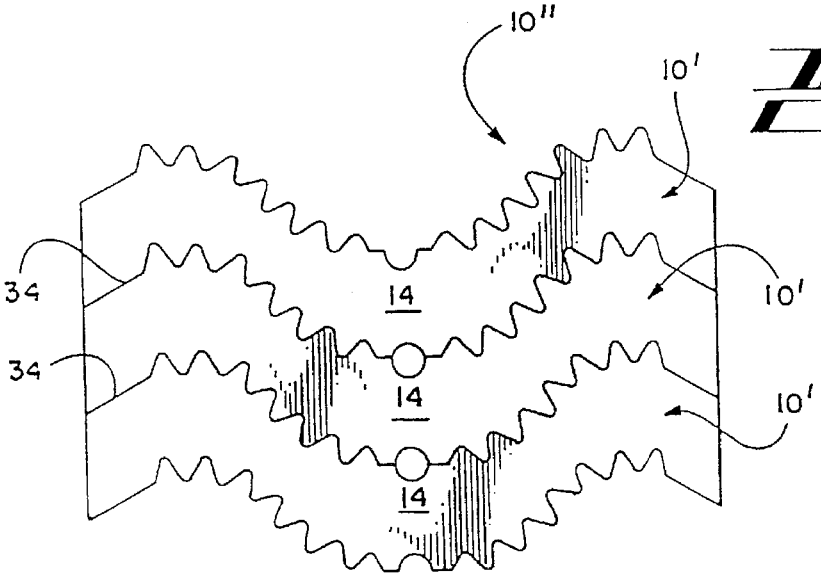
FIG. 3 is plan view of a sheet including multiple nesting blanks of the type shown in FIG. 2.

The blank 10' preferably is made of recycled paperboard material, and is itself recyclable. Other flexible sheet materials could be used, for example, plastic, light corrugated board, or virgin paperboard. A plurality of blanks 10' may be die cut together in a sheet 10" as shown in FIG. 3, in a well known manner. The adjacent blanks 10' in the sheet 10" are shaped so that the upper edge of one blank nests together with the lower edge of the adjacent blank. It will be seen that the V-shaped cuts 22 of the blank 10' of FIG. 2 are made by a zigzag cut 34 between blanks 10' as shown in FIG. 3. The cut 34 creates tips 26 separated by V-shaped cuts in both adjacent blanks 10'. The cuts 34 separating individual blanks 10' are perforated to allow easy separation of the blanks.

Figure 8:
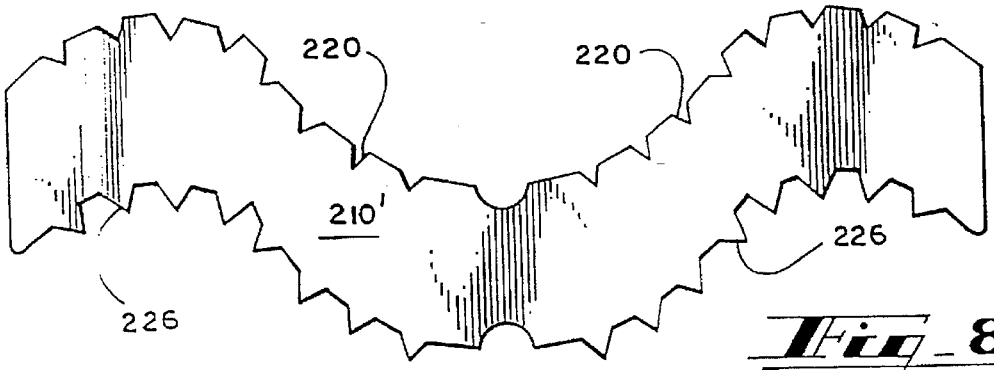
FIG. 8 is a plan view of a blank for forming still another embodiment of a dunnage element according to the invention.

Those skilled in the art will understand that the cut 34 can have many different shapes and still provide a catching action in a bed of the dunnage elements. For example, as shown in FIG. 8, one edge of a blank 210' could have spaced apart triangular projections 226, resulting in corresponding spaced apart V-shaped cut-outs 220 in the opposite edge. Also, the edges could be formed with rounded scallops deep enough to prevent migration depending on the nature of the article to be packed, or spaced apart U-shaped cut-outs in one edge with corresponding rounded projections from the opposite edge.

To form the dunnage element 10 as shown in FIGS. 1 and 4 from the flat blank 10', the first and second ends 24 and 25 are brought together into a tucked portion 35, with the outer surface of the strip 14 adjacent to the end 24 joined to the outer surface of the strip 14 adjacent to the end 25. The dunnage element thus forms a segment of a tube having a generally heart-shaped cross section, best shown in FIG. 4. When an appropriate paperboard material is used, no weakening lines are needed to form the rounded wall of the tube, although vertical score lines could be provided in the case of a heavier or corrugated material.

The ends 24 and 25 may be joined by an adhesive 37, or by another fastening mechanism. For example, a hot melt adhesive may be applied soon prior to bringing the ends together, and the ends held until the adhesive sets. Alternatively, a heat sensitive, thermosetting adhesive may be applied to the blank earlier, and the ends heated as they are brought together and held until the adhesive sets. Also, mechanical fastening means are possible, such as punch-through locking tabs of a type known in the art, or engagement of a separate slotted tab with aligned slits cut into the ends 24 and 25, or staples, clips or the like.

A feature of the shape of the dunnage element 10 is the slanted or angled orientation of the edges 24 and 25 with respect to a vertical or central axis E of the heart-shaped tube. This configuration results in the preferred embodiment from the sinusoidal shape of the strip 14. Thus, it will be seen in FIG. 5 that a radial projection C of the upper edge point 20*a* inward from the tucked ends passes above the central portion 30 of the strip, and a radial projection D of the lower edge point 21*a* inward from the tucked ends intersects the central portion 30.

It also will be seen that a plane F roughly aligned with the upper and lower edges is inclined with respect to the central axis E of the tubular element 10 such that the lowest points on both edges are on the same side of the central axis. It should be understood that planes roughly aligned with the upper and lower edges need not be parallel. The configuration of the tubular member also is characterized in the preferred embodiment by a shortest diameter G, taken parallel to the tucked and joined ends 24 and 25, that is smaller than a longest diameter J, taken across the tucked and joined ends 24 and 25, as shown in FIG. 4. In the embodiment shown, the shortest diameter G greater than the height H. The diameters may vary depending on the nature of the load to be applied. Packing larger, heavier articles generally requires smaller diameter dunnage elements 10.

A particularly preferred dunnage element includes a strip made of 20–22 pt. paperboard (0.50–0.56 mm) that has a height H of about 1.25 inches (3.2 cm), a shortest diameter G of about 1.1 inches (2.9 cm), a longest diameter of about 2 inches (5 cm), and V-cuts 22 of depth and width between tips both about 0.25 inch (6.4 mm).

Those skilled in the art will understand that automatic folding and gluing machinery using known techniques may be constructed to create the dunnage element 10 from the sheet of blanks 10" in a mass production setting, but is not required to make the preferred dunnage elements embodying the present invention. Also, it should be noted that terms such as "vertical," "upper," "lower," and the like are utilized only to provide a relative frame of reference, and not to refer to any absolute direction within the earth's gravitational field.

Figure 6:
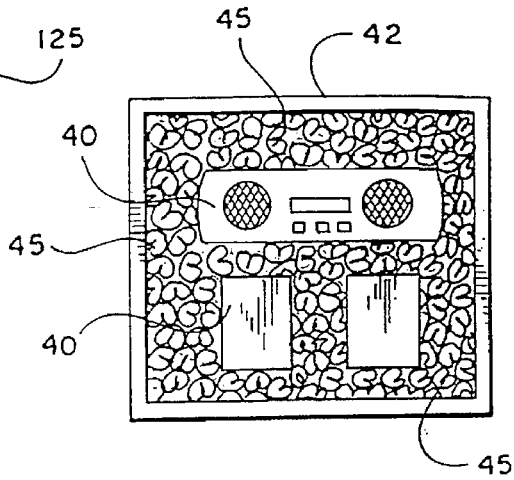
FIG. 6 is a diagrammatic view of a bed of the dunnage elements within a carton.

As shown diagrammatically in FIG. 6, an article 40 may be packed in a carton 42 within a bed 45 of dunnage elements 10. The purpose of the bed 45 is to occupy the empty space in the carton, hold the article 40 near the center of the carton 42, and act as a shock absorber to cushion the article. If the nature of the article is such that only space occupation is needed, the dunnage elements may be made without the serrated edges. The serrated edges cause the elements 10 to catch on one another, resisting the tendency of the article to migrate through the bed to a wall of the carton under the influence of vibration that occurs during shipment. Deeper serrations may be required for heavier articles and shallower serrations may be acceptable for light loads. The dunnage elements 10 protect best against migration if the bed is under pressure. Preferably, the carton should be slightly overfilled with the dunnage elements, and pressure applied on the bed when the carton's closure flaps are folded down and secured.

The cushioning function of the bed is made particularly effective by the combination of the tucked or heart-shaped radial cross section, and the slanted axial cross section of the tubular dunnage element 10. The element 10 may be compressed by opposed inward forces along any line through the center of the element, and it will tend to resiliently spring back. In contrast, a right cylinder is compressible from the sides, but not along its central axis. The dunnage element according to the present invention is resiliently compressible along its central axis or any other axis. The tucked portion provides more springiness upon compression, and helps the element resist fully collapsing under pressure. This structural integrity plus cushioning action results in a bed of paperboard dunnage capable of protecting fragile articles during shipment.

Figure 7:
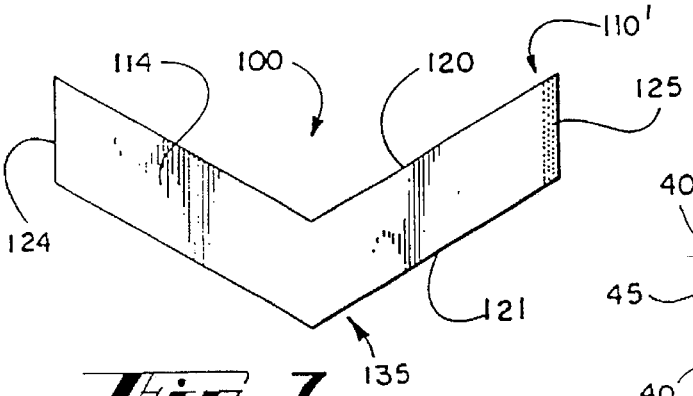
FIG. 7 is a plan view of a blank for forming another embodiment of a dunnage element according to the invention.

FIG. 7 shows an alterative embodiment of the invention. A dunnage element 100 is formed from a blank 110' comprising a V-shaped strip 114 of paperboard. The strip has an upper edge 120 and a lower edge 121 connecting a first end 124 to a second end 125, analogous to the first embodiment described above. The area near the "point" of the V-shaped strip forms a central portion 135. It will be understood that when the strip 114 is formed into a tucked tube with a heart-shaped radial cross section in the manner described above, a slanted axial cross section will result. Although the edges 120 and 121 are shown as being smooth, serrations may be added. The blanks of FIG. 2 and FIG. 7 are only examples of many blanks whose shape will provide a compressible dunnage element when formed to have cross sections generally as shown in FIGS. 4 and 5.

Those skilled in the art will understand that variations and modifications to the preferred embodiments described above can be made without departing from the scope of the invention as defined in the appended claims.

What is claimed is:

1. A dunnage element comprising:

an elongate strip of flexible material defining an outer planar surface, an inner planar surface, an upper elongate edge of said surfaces, a lower elongate edge of said surfaces, a first end, a second end, and a central portion where each of said edges extends to a position spaced below a line connecting points at which said edge meets said ends;

said ends being brought together and tucked, said outer surface adjacent to said first end being joined to said outer surface adjacent to said second end to form a closed figure having a tucked portion spaced axially from said central portion of said strip, said figure being resiliently compressible axially as well as radially.

2. The dunnage element of claim 1, wherein said strip is shaped in a sinusoidal curve, said central portion including a minimum along said sinusoidal curve.

3. The dunnage element of claim 2, wherein said first and second ends are located beyond maxima of said sinusoidal curve next adjacent to said minimum.

4. The dunnage element of claim 1, wherein said elongate edges include serrations.

5. The dunnage element of claim 4, wherein said serrations comprise V-shaped cuts into said strip.

6. The dunnage element of claim 5, wherein said V-shaped cuts are sufficiently deep to catch on serrations of adjacent dunnage elements in a bed of said elements upon vibration of an article packed in said bed.

7. The dunnage element of claim 1, wherein said flexible material comprises paperboard.

8. The dunnage element of claim 1, wherein said paperboard is recycled board having a thickness from about 12 to 40 pt.

9. The dunnage element of claim 1, wherein a radial projection of said upper edge from said tucked ends passes above said central portion, and a radial projection of said lower edge from said tucked ends intersects said central portion.

10. A dunnage system for packing an article, comprising:

a carton;

a plurality of dunnage elements forming a bed surrounding said article, each comprising:

an elongate strip of flexible material defining a first planar surface, a second planar surface, an upper elongate edge of said surfaces, a lower elongate edge of said surfaces, a first end, a second end, and a central portion where each of said edges extends to a position spaced below a line connecting points at which said edge meets said ends;

said ends being brought together and tucked, said first surface adjacent to said first end being joined to said first surface adjacent to said second end to form a closed figure having a tucked portion spaced axially from said central portion of said strip, said figure being resiliently compressible axially as well as radially.

11. The dunnage system of claim 10, wherein each of said strips is shaped in a sinusoidal curve, said central portion including a minimum along said sinusoidal curve.

12. The dunnage system of claim 10, wherein said elongate edges include serrations.

13. The dunnage system of claim 12, wherein said serrations comprise V-shaped cuts into said strip.

14. The dunnage system of claim 13, wherein said V-shaped cuts are sufficiently deep to catch on serrations of adjacent dunnage elements in said bed upon vibration of said article packed in said bed, so as to prevent significant migration of said article within said bed.

15. A dunnage element, comprising:

a tube formed of flexible material, said tube having a generally heart-shaped cross section, a generally heart-shaped upper edge, and a generally heart-shaped lower edge;

said upper edge being oriented such that a plane roughly aligned with said upper edge is inclined with respect to a central axis of said tube; and said lower edge being oriented such that a plane roughly aligned with said lower edge is inclined with respect to the central axis of said tube with a lowest point on said upper edge being on the same side of said axis as a lowest point on said lower edge.

16. The dunnage element of claim 15, wherein said upper and lower edges are generally parallel to one another.

17. The dunnage element of claim 16, wherein said upper and lower edges are serrated.

18. The dunnage element of claim 15, wherein the shortest diameter across said tube is equal to or greater than the height of said tube.

* * * * *